United States Patent [19]

Robinson

[11] Patent Number: 4,934,073

[45] Date of Patent: Jun. 19, 1990

[54] EXERCISE-ENHANCING WALKING SHOE

[76] Inventor: Fred M. Robinson, 1730 Maywood Place, Clarksdale, Miss. 38614

[21] Appl. No.: 379,206

[22] Filed: Jul. 13, 1989

[51] Int. Cl.[5] ..... A43B 7/14; A63B 23/04

[52] U.S. Cl. ..... 36/91; 36/25 R; 36/28; 36/103; 272/96

[58] Field of Search ..... 36/110, 25 R, 99, 7.3, 36/8.4, 91, 108, 103, 28, 88, 112, 116, 81; 272/96, 119; 128/83, 83.5, 613

[56] References Cited

U.S. PATENT DOCUMENTS

| | | | |
|---|---|---|---|
| Re. 31,173 | 3/1983 | Daswick | 36/30 R |
| 2,054,188 | 9/1936 | Bates | 36/12 |
| 2,519,613 | 8/1950 | Urban | 36/1 R |
| 2,769,252 | 11/1956 | Monier | 36/8.5 |
| 2,847,769 | 8/1958 | Schlesinger | 36/91 |
| 2,855,704 | 10/1958 | Schlesinger | 36/91 |
| 3,305,947 | 2/1967 | Kalsoy | 36/132 |
| 3,472,508 | 10/1969 | Baker et al. | 272/96 |
| 3,739,500 | 6/1973 | Cox | 36/99 |
| 3,820,254 | 6/1974 | Kopacsi | 36/110 |
| 3,964,181 | 6/1976 | Holcombe, Jr. | 36/91 |
| 4,155,180 | 5/1979 | Phillips | 36/129 |
| 4,526,365 | 7/1985 | Ziegerbaum | 272/96 |
| 4,546,557 | 10/1985 | Barovk et al. | 36/110 |
| 4,573,678 | 4/1986 | Lamb et al. | 272/96 |
| 4,681,114 | 7/1987 | Lodispoto | 128/581 |
| 4,686,993 | 8/1987 | Grumbine | 128/581 |
| 4,726,127 | 2/1988 | Barouk | 36/110 |

*Primary Examiner*—Steven N. Meyers

*Attorney, Agent, or Firm*—Cushman, Darby & Cushman

[57] ABSTRACT

A walking shoe is provided between its outer and inner soles, and substantially hidden by the ramp at the instep and toe, with a reverse wedge, i.e., one which increases in thickness in the forward direction. The reverse wedge terminates forwards of the shoe heel. The reverse wedge and the sole of which it forms a part remain flexible. The objective is the provision of a shoe which enhances the amount of exercise provided to the wearer's foot and leg muscles while walking.

3 Claims, 1 Drawing Sheet

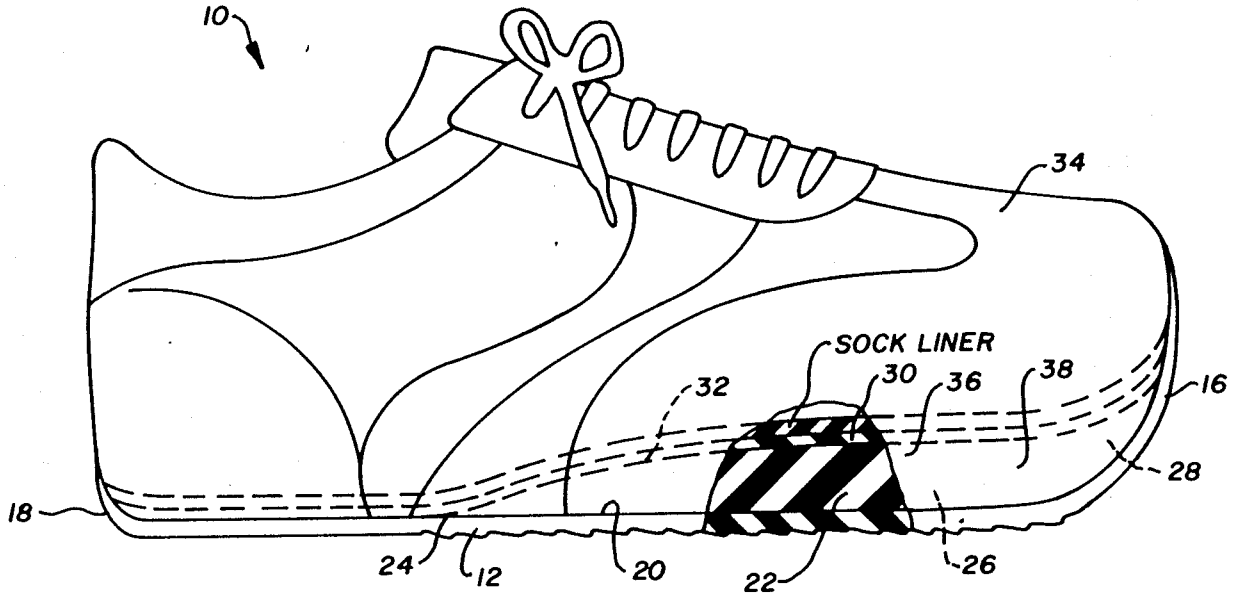
10
34
16
28
38
SOCK LINER
36
30
32
26
22
20
12
24
18

EXERCISE-ENHANCING WALKING SHOE

BACKGROUND OF THE INVENTION

In typical conventional walking shoes, the wearer's heels are elevated above the wearer's toes and the balls of the wearer's feet when the wearer is standing. In some slippers, the heels, toes and balls of the feet of the wearer are coplanar. In a few prior art instances, shoes have been provided with reverse wedges (i.e., ones which are taller in front and taper rearwardly), but so far as the present inventor is aware, in each of the latter instances, the reverse wedge has extended under the wearer's heel, and/or the reverse wedge has been provided on the outside of the bottom of the sole as a rather obvious addition. In some instances, the reverse wedges have been applied to rigid soles, or have caused the soles to which they were added to become rigid soles. These features have, in the estimation of the present inventor, limited the amount of exercise that a reverse wedge can provide to a shoe and/or limited the potential market for reverse wedge exercise-enhancing shoes.

SUMMARY OF THE INVENTION

A walking shoe is provided between its outer and inner soles, and substantially hidden by the ramp at the instep and toe, with a reverse wedge, i.e., one which increases in thickness in the forward direction. The reverse wedge terminates forwards of the shoe heel. The reverse wedge and the sole of which it forms a part remain flexible. The objective is the provision of a shoe which enhances the amount of exercise provided to the wearer's foot and leg muscles while walking.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing

The figure is a side elevational view of a shoe provided in accordance with principles of the present invention, with a portion broken away and sectioned, in order to expose internal structural features.

DETAILED DESCRIPTION

A shoe 10 embodying principles of the present invention is shown in the drawing figure. It may be made entirely of materials conventionally used in the construction of casual shoes, walking shoes, dress shoes, running shoes and the like. Although a lace-up style is preferred, other styles of shoes could be made using the principles of the present invention.

The main purpose of the shoe 10 is to provide its wearer with enhanced exercising of foot and leg muscles, while walking.

The major components of the shoe 10 include an outsole 12, the lower, external face 14 thereof is preferably substantially planar, except that it preferably conventionally turns up adjacent and leading to the front of its toe and the rear of its heel, as indicated at 16, 18. In addition, the surface 14 may be conventionally provided with an incised or molded-in tread design, for improving traction on wet or muddy surfaces, for improving impact rebound characteristics, and the like.

Applied on the upper surface 20 of the outsole 12, e.g., by adhesion using a conventional shoe adhesive and/or sewing, is a reverse wedge 22. The reverse wedge begins at 24 at the location of the rear of the wearer's arch, to the rear of the ball of the wearer's foot and forwards of the location of the wearer's heel, and increases forwardly (tapers rearwardly) in thickness, reaching its thickest in the region 26, under the ball of the wearer's foot. From forwardly of the ball of the wearer's foot, the reverse wedge tapers at 28, under the tips of the wearer's toes and forwardly of the wearer's foot.

An insole 30 is applied on the upper side 32 of the composite of the outsole and reverse wedge. Again, the connection of the parts is made by conventional means, such as convention shoe adhesive and/or sewing.

An upper 34, including a toe box, vamp and heel quarters may be conventionally mounted, e.g., by adhesive and/or stitching, to the composite formed of the outsole, reverse wedge and insole. The vamp and toe box of the upper 34 preferably include lateral and medial lower edge portions 36 which overlap most or all of the side edges 38 of the reverse wedge, are all but a substantially uniform-thickness exposed portion of the composite reverse wedge/outsole structure.

Accordingly, to a casual observer, the shoe 10 looks very much like a conventional shoe, albeit one that is somewhat taller across the instep and toe box.

For the wearer, a feeling of reasonable self-confidence in appearance is preserved, because the shoe, when worn, does not look 'odd'. Yet, in walking, the wearer is provided with enhanced exercise, due to the fact that, when standing on a level, horizontal surface, the wearer's heels are lower than the wearer's toes.

At its thickest, in the region 26, the reverse wedge 22 preferably is 0.5 to 1.0 inch thick.

The shoe 10 can be worn all day as a regular shoe, by the wearer, or only for shorter periods, e.g., while taking a walk for exercise.

Because the front of the wearer's foot is caused to be elevated relative to the wearer's heel when standing in the shoe, when walking, the wearer must lift their foot higher when stepping forwards, and placing their foot down. This results in an enhanced amount of exercise to the wearer's foot and leg muscles, and particularly to their shin muscles. When stepping forwards, the wearer must lift their foot from an attitude in which their heel is lower than the ball of their foot. This results in an enhanced amount of exercise to the wearer's foot and leg muscles, and particularly to their calf muscles.

By preference, the insole of the shoe 10 is made of conventional fabric used for shoe insoles, the outsole is made of conventional rubber (natural or synthetic) used for shoe outsoles, and the reverse wedge 22 is made of foam or sponge rubber, natural or synthetic, e.g., of the kinds conventionally used for manufacturing running shoes, tennis sneakers and basketball court shoes. It is flexible and resilient. The composite sole preferably has approximately the flexibility of a Rockport® walking shoe or Nike® AirJordan® basketball court shoe, in the region under the wearer's instep and subject to the most flexure.

The shoe upper is preferably made of canvas, leather or other conventional composite materials used in the manufacture of sneakers and other sport shoes.

The shoe 10 may be provided with any conventional accoutrements such as shoe eyes and laces, tongue, reflectors, pockets, logos, graphics, sock liner and the like.

It should now be apparent that the exercise-enhancing walking shoe as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An exercise-enhancing walking shoe comprising:

an outsole having a substantially planar bottom, but which turns up under tips of a wearer's toes;

an insole having a front portion to underlie the wearer's toes and a ball of the wearer's foot, a middle portion to underlie a wearer's arch behind the ball of the wearer's foot, and forwardly of the wearer's heel, and a rear portion to underlie a wearer's heel;

a reverse wedge having an upper surface, a lower surface and an outer edge including a rear portion, the reverse wedge increasing forwardly in thickness and decreasing rearwardly in thickness, so as to taper to extinction at said rear portion of said outer edge, at a location arranged to under lie the wearer's foot to the rear of the ball of the wearer's foot, but forwardly of the wearer's heel, and so as to achieve a maximum thickness substantially under the ball of the wearer's foot, and forwardly tapering to a lesser thickness under the wearer's toe tips;

said insole, reverse wedge and outsole being connected together, sandwich fashion, to provide a composite sole, with said reverse wedge being substantially completely absent from between said rear portion of said insole and said outsole;

said composite sole being resilient and flexible; and a shoe upper including a toe box, an instep and rear quarters; said shoe upper having a perimetrically extending lower edge portion secured to an outer peripheral edge of said composite sole so as to provide an upwardly-opening enclosure for receiving the wearer's foot;

said composite sole being of such thickness, that when said shoe is worn by a person standing on level horizontal ground, the person's heel is located at a level substantially below the ball of the person's foot.

2. The exercise-enhancing walking shoe of claim 1, wherein:

said peripheral edge of said shoe upper laps over said composite sole sufficiently to hide from view externally of the shoe all but a band of said outer peripheral edge that is substantially constant in thickness along said shoe from toe to heel.

3. The exercise-enhancing walking shoe of claim 2, wherein:

said reverse wedge is made of sponge rubber.

* * * * *